US008011510B1

(12) United States Patent
Smith, II et al.

(10) Patent No.: US 8,011,510 B1
(45) Date of Patent: Sep. 6, 2011

(54) SYSTEM AND DEVICE FOR DISPLAYING, PROTECTING, AND STORING ITEMS

(76) Inventors: James Earl Smith, II, Culpeper, VA (US); James Earl Smith, Bruceton Mills, WV (US)

( * ) Notice: Subject to any disclaimer, the term of this patent is extended or adjusted under 35 U.S.C. 154(b) by 41 days.

(21) Appl. No.: 11/694,113

(22) Filed: Mar. 30, 2007

Related U.S. Application Data

(60) Provisional application No. 60/788,175, filed on Mar. 31, 2006.

(51) Int. Cl.
*B65D 85/62* (2006.01)

(52) U.S. Cl. ..... 206/509; 206/470; 206/449

(58) Field of Classification Search ..... 206/470, 206/806, 807, 509, 461, 471, 503–508, 510–512, 206/525, 449
See application file for complete search history.

(56) References Cited

U.S. PATENT DOCUMENTS

| | | | | | |
|---|---|---|---|---|---|
| 2,506,844 | A | | 5/1950 | Smith | |
| 3,150,457 | A | | 9/1964 | Thieme | |
| 4,124,141 | A | | 11/1978 | Armentrout et al. | |
| 4,499,353 | A | * | 2/1985 | Shields | 206/470 |
| 4,555,056 | A | * | 11/1985 | Bernhardt | 206/807 |
| D281,580 | S | * | 12/1985 | Stevens | D9/415 |
| 4,687,129 | A | * | 8/1987 | Cugley | 206/470 |
| 4,739,883 | A | * | 4/1988 | Mohs et al. | 206/470 |
| 4,807,747 | A | | 2/1989 | Hadtke | |
| 4,829,691 | A | | 5/1989 | Manjos et al. | |
| 4,979,619 | A | | 12/1990 | Hager | |
| 5,040,671 | A | | 8/1991 | Hager | |
| 5,042,650 | A | | 8/1991 | Mayer et al. | |
| 5,096,084 | A | | 3/1992 | Wells | |
| 5,097,953 | A | | 3/1992 | Gingras | |
| 5,156,267 | A | * | 10/1992 | Yates et al. | 206/470 |
| 5,411,140 | A | | 5/1995 | Byer | |
| 5,577,609 | A | * | 11/1996 | Hexter, Jr. | 206/449 |
| 5,699,925 | A | | 12/1997 | Petruzzi | |
| 5,833,116 | A | | 11/1998 | Guillin | |
| 5,964,350 | A | | 10/1999 | LaMarche et al. | |
| 5,984,091 | A | * | 11/1999 | Orr et al. | 206/471 |
| 6,050,408 | A | * | 4/2000 | Testa | 206/361 |
| 6,237,772 | B1 | | 5/2001 | LaMarche et al. | |
| 6,250,494 | B1 | | 6/2001 | Diamond | |
| 6,308,831 | B1 | | 10/2001 | Saxe et al. | |

* cited by examiner

*Primary Examiner* — J. Gregory Pickett
*Assistant Examiner* — Andrew Perreault
(74) *Attorney, Agent, or Firm* — Thompson Hine LLP

(57) ABSTRACT

A protective enclosure for displaying, protecting and storing flat items and most preferably to protect, store, and display flat collectible items such as comic books and other printed documents. The protective enclosure is formed of a upper face and lower face foldably connected by a living hinge. The lower face has a protective recess adapted to receive an item to be stored, wherein the upper face and lower face form an interlocking surface around the protective recess when the protective enclosure is in a closed position. A label area also is formed from a upper label area of the upper face and a lower label area of the lower face. The protective enclosure has an interlocking stacking interface adapted for removably receiving an interlocking stacking interface of a second protective enclosure.

20 Claims, 9 Drawing Sheets

SYSTEM AND DEVICE FOR DISPLAYING, PROTECTING, AND STORING ITEMS

CROSS-REFERENCE TO RELATED APPLICATION

This application claims the benefit of U.S. Application No. 60/788,175 filed on Mar. 31, 2006.

BACKGROUND

1. Technical Field

The present invention relates to a system and device for protecting, storing, and displaying any item, but preferably to protect, store, and display flat items and most preferably to protect, store, and display flat collectible items such as comic books and other printed documents.

2. Related Art

People commonly protect, store, and display flat items, such as comic books and other flat collectible items, using plastic bags with backing boards to add rigidity, corrugated plastic boxes, and specially constructed folders or shelving systems. Collectors in particular are seeking an effective system and device to safely store, display, and ship their items. In particular, collectors want to protect and display their collections while securing the value of their investments in the collectible items by minimizing the risk of damage occurring to the collectible during handling, shipping and display.

BRIEF DESCRIPTION OF THE DRAWINGS

The accompanying figures depict multiple embodiments of the system and device for displaying, protecting, and storing items. A brief description of each figure is provided below. Elements with the same reference numbers in each figure indicate identical or functionally similar elements. Additionally, the left-most digit(s) of a reference number identifies the drawings in which the reference number first appears.

DETAILED DESCRIPTION OF THE INVENTION

1. Protective Enclosure

The system and device disclosed herein is designed to protect, store and display any item, but preferably protect, store and display flat items. The system and device is easily modified by one of ordinary skill in the art to protect, store, and display a number of flat items including, but not limited to, patches, stamps, magazines, comics, coins, trading cards, certificates, and other important documents.

Figure 1:
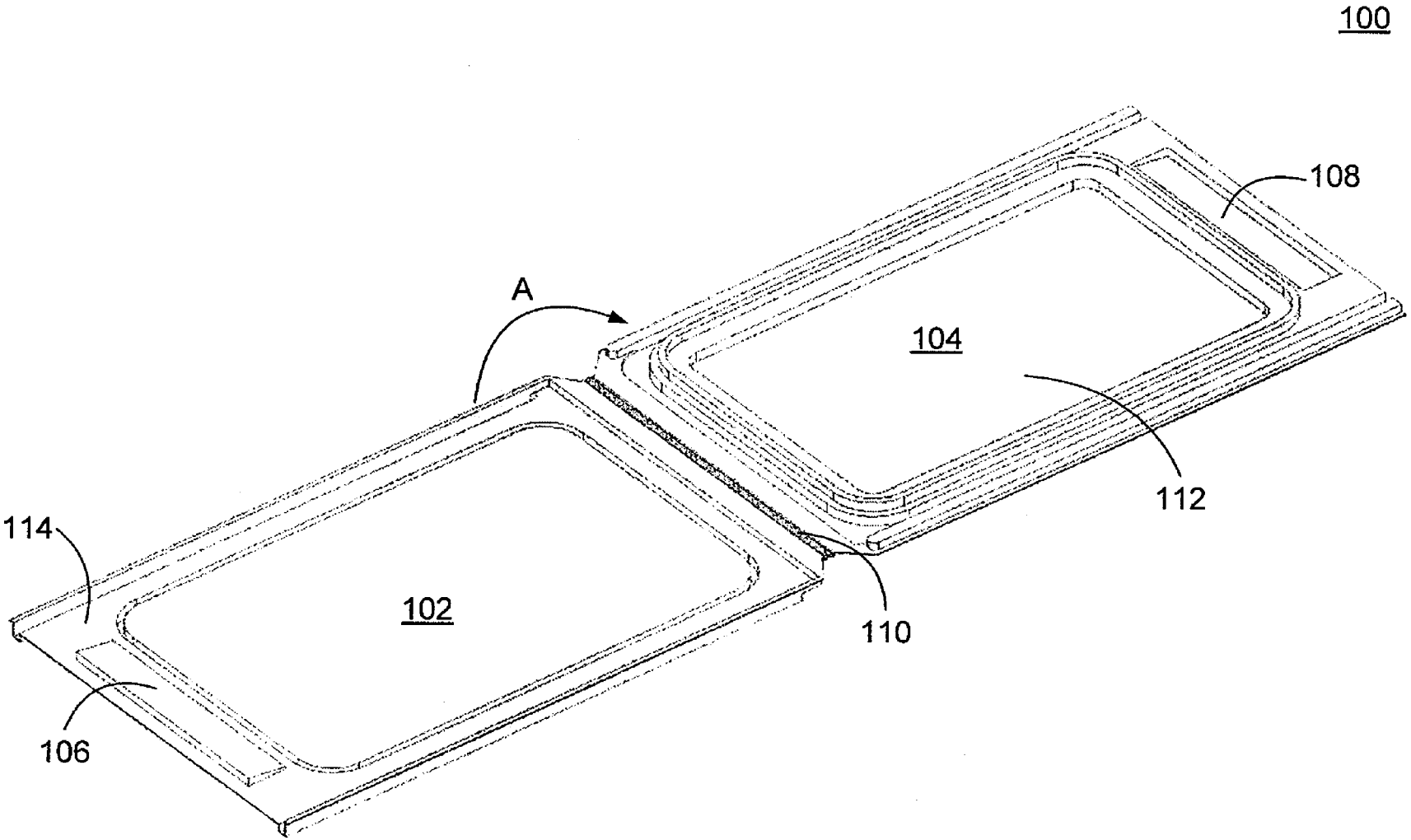
FIG. 1 is a perspective view of the inner surface of a protective enclosure.
Figure 2:
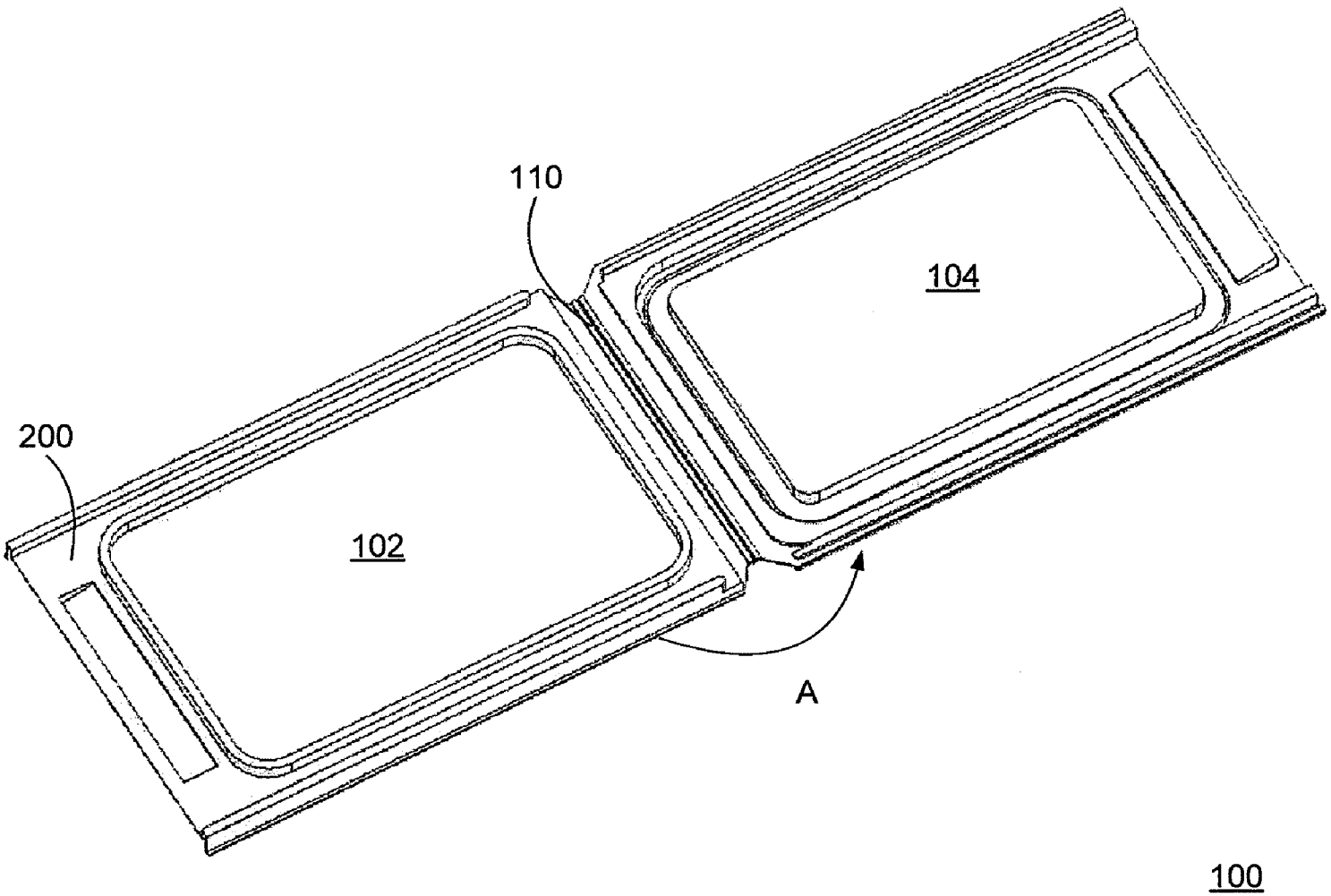
FIG. 2 is a perspective view of the outer surface of a protective enclosure.

FIG. 1 is a perspective view of the inner surface 114 of the protective enclosure 100 in an open position and FIG. 2 is a perspective view of the outer surface 200 of the protective enclosure 100 in an open position. The protective enclosure 100 includes an upper face 102 and a lower face 104. The upper face 102 has a upper label area 106, while the lower face 104 has a lower label area 108. The upper label area 106 and the lower label area 108 in one embodiment are adapted to accept a 1" by 5" card, label or tag between themselves when the lower face 104 is folded against the upper face 102. The card in the label area 300 (shown on FIG. 3) allows easy cataloguing and inventory of the contents of a protective enclosure 100 without the need to move that protective enclosure 100 from an interlocking stack of multiple protective enclosures 100.

The upper face 102 is separated from the lower face 104 by a living hinge 110. The living hinge 110 is a thin section of plastic that enables the lower face 104 to be folded and closed against the upper face 102. Features and characteristics of a living hinge 110 are well known to those of ordinary skill in the art. The arrow A indicates the direction of rotation of the upper face 102 onto the lower face 104 along the living hinge 110 to close the protective enclosure 100 as shown in part in FIG. 3. The lower face 104 has a protective recess 112 formed within it for housing an item stored inside a protective enclosure 100 in the closed position.

1.a. Label Window

Figure 3:
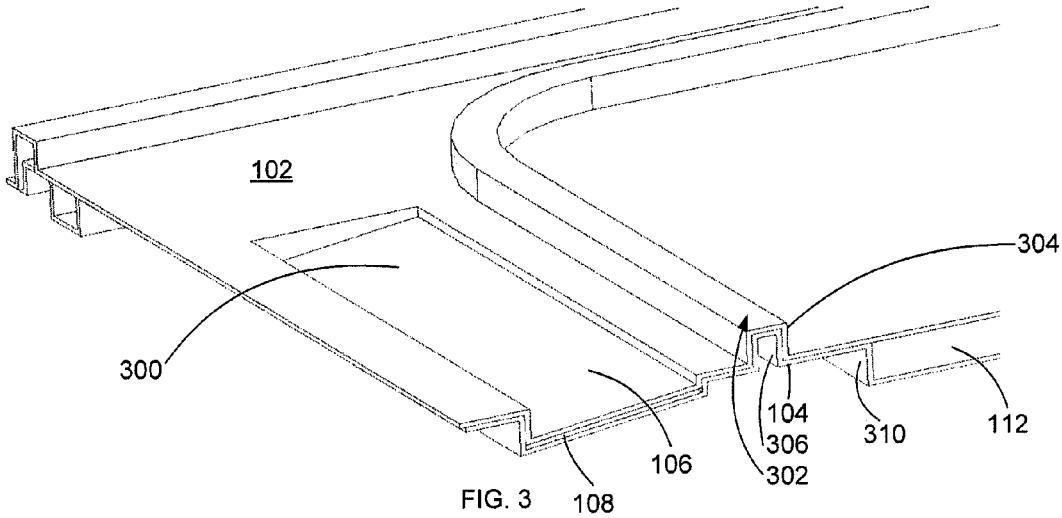
FIG. 3 is a cutaway perspective view of the two faces of a protective enclosures mated to form a closed protective enclosure with the label window shown.

FIG. 3 is a cutaway perspective view of the upper face 102 and the lower face 104 of the protective enclosure 100 mated to form a closed protective enclosure 100 with the label window 300 shown. The label window 300 is formed by the upper label area 106 and the lower label area 108. The size of the folds that form the upper label area 106 and the lower label area 108 enable placement of a paper or plastic label 900 (shown in FIG. 9) between the upper label area 106 and the lower label area 108. Alternatively, an adhesive label may be attached to the outside surface of the label window 300. The label window 300 is angled, preferably about 5 degrees to about 15 degrees for thin protective enclosures 100 and up to a maximum of about 30 degrees for thicker ones, for easy viewing when the protective case 100 is either stacked or on display in the protect enclosure display system 1000 (see FIG. 10). The protective recess 112 is formed by the recess walls 310 that surround the extents of the protective recess 112 in the lower face 104.

1.b. Locking Interface

A locking interface 302 is formed between the material of the upper face 102 and the lower face 104. The upper locking interface 304 is formed in the material of the upper face 102 and is sized and shaped to accept the lower locking interface 306. In one embodiment, the upper locking interface 304 is sized to accept the lower locking interface 306 with an interference fit. In the embodiment of the protective enclosure 100 shown in FIGS. 1, 2, and 3, the locking interface 302 forms a continuous line or perimeter around the protective recess 112. The locking interface 302 thus provides a dust and moisture inhibiting barrier between the item stored within the protective recess 112 of the closed protective enclosure 100 and the outside world. In still another embodiment, the locking interface 302 is formed such that it is substantially water resistant, further protecting an item stored within the protective enclosure 100.

In still another embodiment, the locking interface 302 is formed with a sealant or adhesive inside that creates a permanent seal between the upper locking interface 304 and the lower locking interface 306 thereby sealing the protective recess 112 of the closed protective enclosure 100. In yet another embodiment, the locking interface 302 is formed with a gasket-like material, e.g., a foam ring or gasket, that provides additional sealing protection for the protective recess 112.

1.c. Interlocking Stacking Interface

Figure 4:
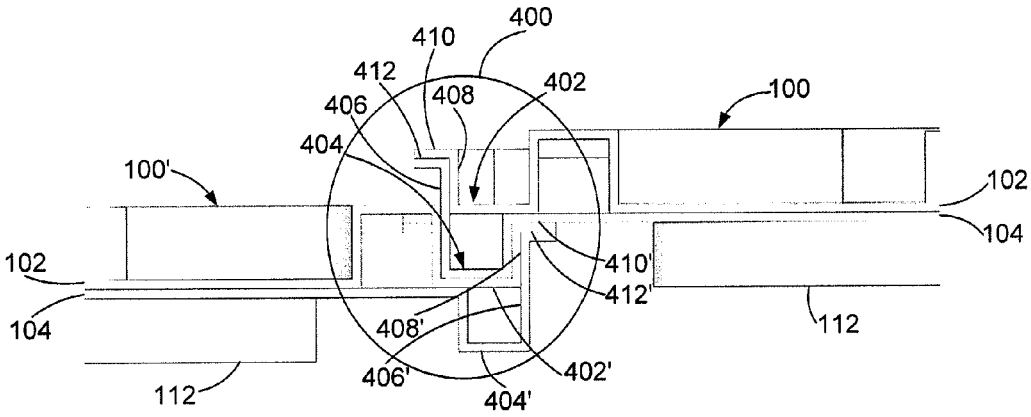
FIG. 4 is a cutaway view of the interlocking system enabling multiple protective enclosures to be mated together into a self aligning columns or rows and columns.

FIG. 4 details the aspects of the interlocking stacking interface 400. The interlocking stacking interface 400 enables the closed protective enclosures 100 to be stacked either on top of each other in columns or in adjoining rows and columns. In the embodiment shown in FIG. 4, two protective enclosures 100 are placed side to side in a row. The interlocking stacking interface 400 extends along the length of both long sides of the protective enclosure 100 and enables the protective enclosure 100 to be stacked safely and effectively without the need for specialized external hardware for supporting and handling each unit. The interlocking stacking interface 400 also enables a single protective enclosure 100 to be selectively removed from a stack of multiple protective enclosures 100 without disturbing the stability of a row and column stack. In FIG. 4, the elements of the left most protective enclosure 100' that are equivalent to those found on the right most protective enclosure 100 are denoted by a (') mark.

The interlocking stacking interface 400 is formed of two primary elements, the upper stacking lip 402 that is formed as part of the upper face 102 and the lower stacking lip 404 that is formed as part of the lower face 104. The upper stacking lip 402 and the lower stacking lip 404 are connected by an upper raised ledge 410 and lower raised ledge 412 respectively by an inner vertical edge 408 and an outer vertical edge 406. The complementary upper stacking lip 402' and lower stacking lip 404' on a second or left protective enclosure 100' is also shown to highlight the interlocking stacking interface 400. Also shown are the complementary upper raised ledge 410' and lower raised ledge 412' and inner vertical edge 408' and outer vertical edge 406' for the left most protective enclosure 100'.

The external face of the lower stacking lip 404, 404' is adapted to fit and slide substantially freely along the internal face of an upper stacking lip 402' located on a left most protective enclosure 100'. The lower, outer vertical edge 406 of the lower stacking lip 404 is adapted to fit on the upper, outer vertical edge 408' of the mating upper stacking lip 402'. The interlocking features of the interlocking stacking interface 400 enable the protective enclosures 100 to be interlocked both vertically and horizontally, thereby creating a row and column array of protective enclosures 100.

The interlocking stacking interface 400 is adapted in this embodiment such that when multiple protective enclosures 100 are stacked on top of each other there is sufficient clearance created between upper surface 102 of the upper stacking lip 402 and the lower surface 104 of the lower stacking lip 404 to keep the remaining elements of the upper face 102 and the lower face 104, including the outer surface of the protective recess 112 from touching the protective enclosures 100 that are located immediately above and below the selected protective enclosure 100. Since the interlocking stacking interface 400 allows the individual protective enclosures 100 to nest within the respective upper and lower stacking lips 402, 404 of the protective enclosures 100 above and below, a stable stack or column of protective enclosures 100 is readily formed as well.

1.d. Protective Enclosure 100 Material Selection

The protective enclosure 100 may be selected from a number of different types of material. Preferably the material is a plastic. Most preferably, the plastic is selected from the group consisting of polyvinylchloride (PVC), Amorphous Polyethylene Terephthalate (APET), polycarbonate, polystyrene, and polyethylene. The material used for the protective enclosure 100 in some embodiments provides ultraviolet (UV) light spectrum protection. In another embodiment, the materials selected for the protective enclosure 100 are selected such that they are substantially transparent, thereby enabling a person to view the item stored within. In yet another embodiment, the materials used for the protective enclosure 100 is formed from two separate materials that are joined to create portions of the protective enclosure 100 that have different levels of transparency, including different hues and colors ranging from clear to opaque. In still another embodiment, the upper face 102 is formed of a substantially transparent material while the lower face 104 is formed of a substantially opaque material. The selection of materials to achieve a variety of cosmetic and functional outcomes is well known to those of ordinary skill in the art. Another criteria used by designers in selecting the materials used to form the protective enclosure 100 is to provide protection and substantially maintain the seal integrity of the protective enclosure 100 when it is dropped, or alternatively to prevent collapse when items of specific weight and surface area are placed on the surface of the protective enclosure 100.

In the embodiment of the protective enclosure 100 depicted herein, the material is selected to enable the protective enclosure 100 to be fabricated as a single piece using vacuum molding. In alternative embodiments, the protective enclosure 100 may be formed from multiple elements that are welded or glued or otherwise fitted together. In yet another embodiment, the protective enclosure 100 is formed using a process selected from the following injection molding, die casting, stamping, and casting.

1.e. Protection of Book-Like Flat Items

Figure 5:
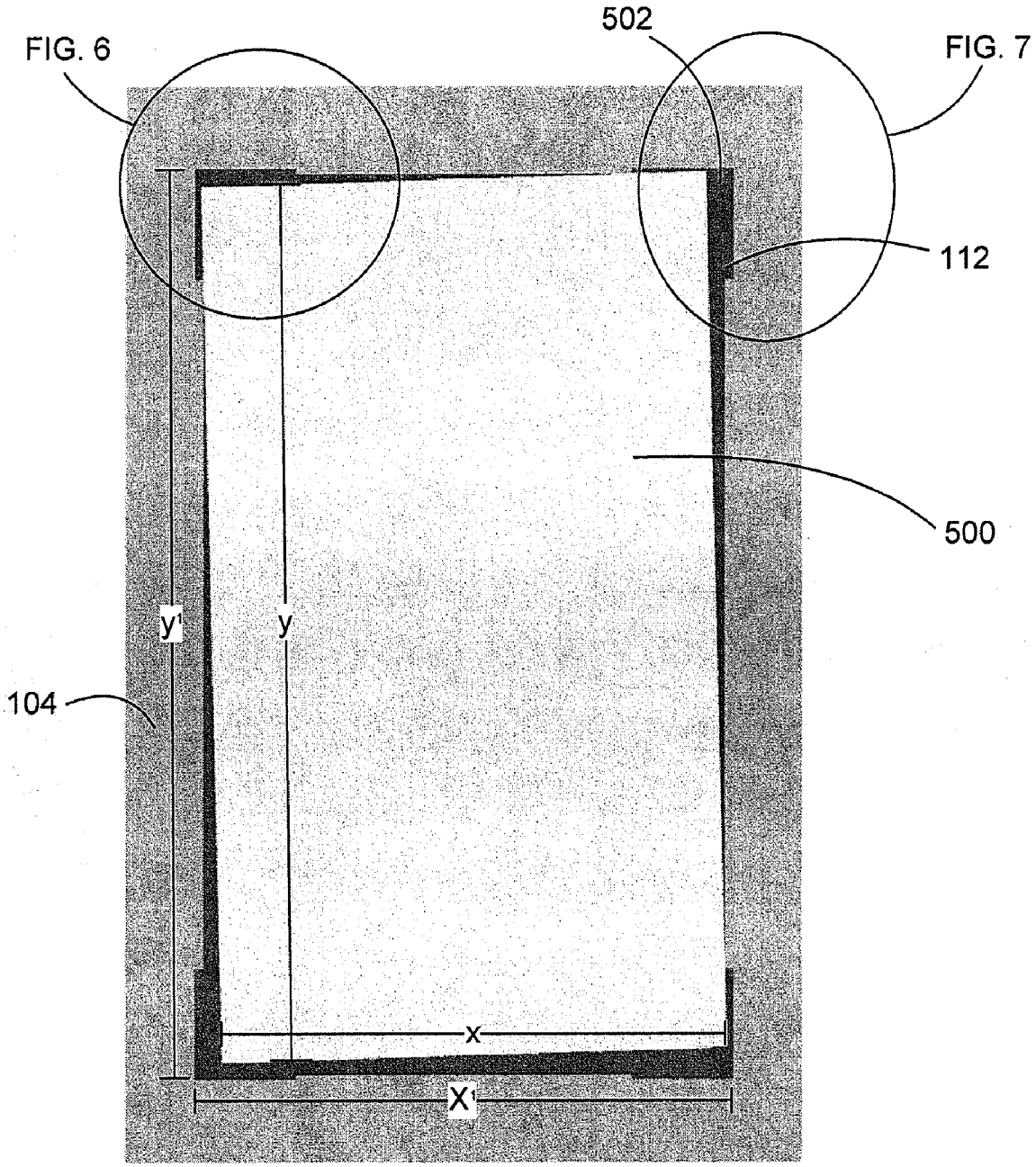
FIG. 5 highlights the effect of the clearance and corner pockets to protect the corners of a flat item enclosed within the protective enclosure.
Figure 6:
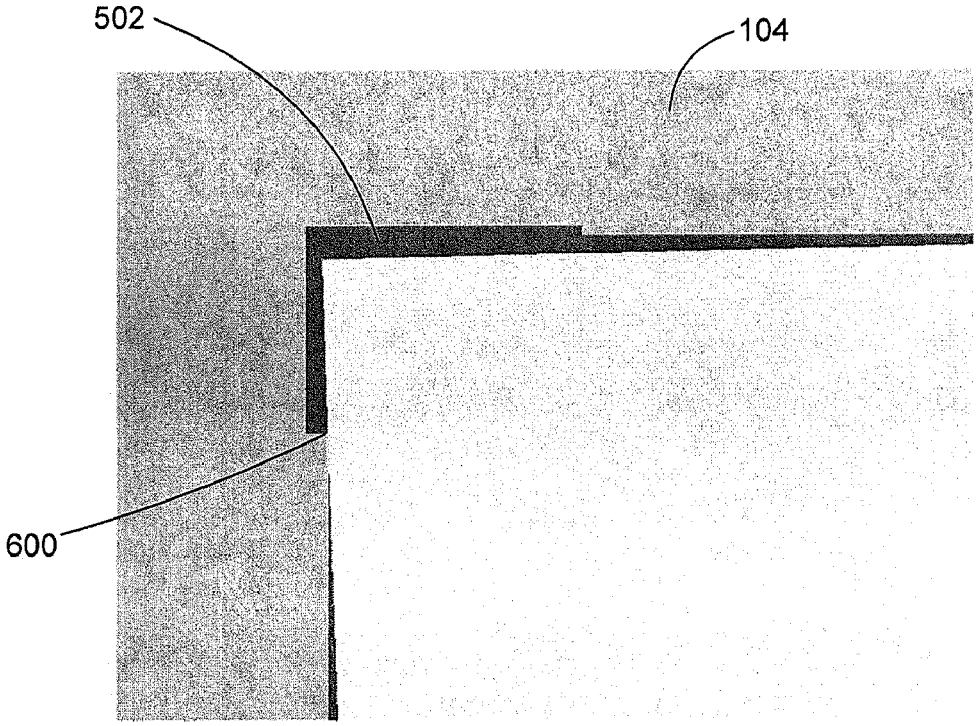
FIG. 6 is a detail view of one corner shown in FIG. 5.
Figure 7:
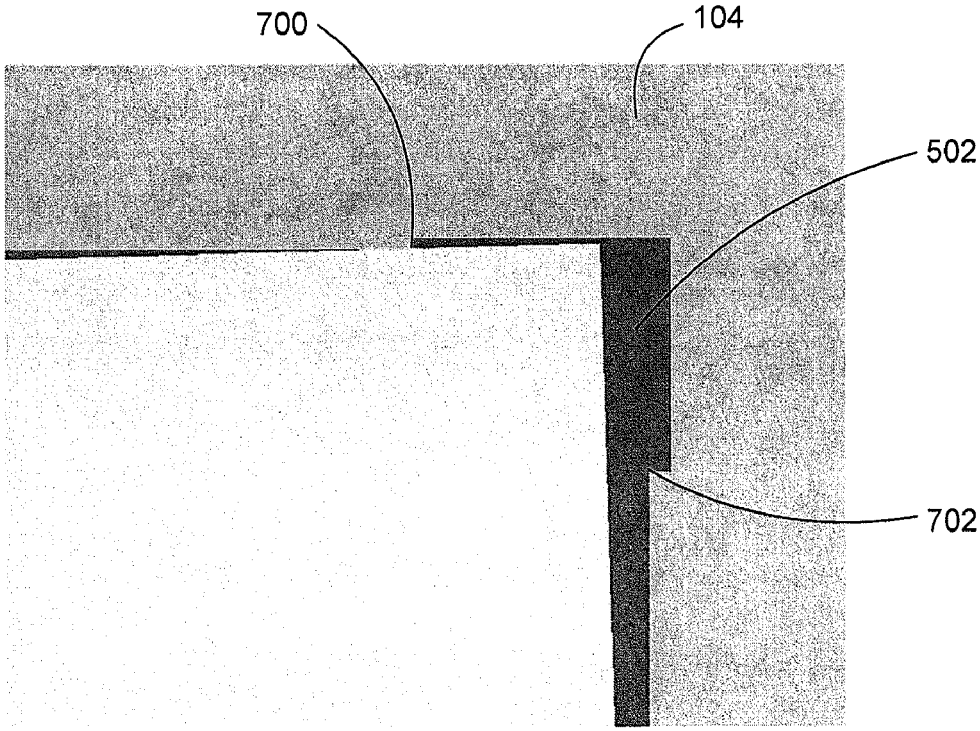
FIG. 7 is a detail view of a second corner shown in FIG. 5.

In yet another embodiment, shown in FIGS. 5-7, the protective enclosure 100 is adapted to protect a substantially book-like flat item 500, such as a book, magazine, or comic book within its protective recess 112. In this case, the flat item 500 is sized as a typical US comic book 6.625"×10.25". In alternative embodiments, the flat item 500 is sized for a specific type of book or other collectable item. The lower face 104 is shown in outline in FIG. 5. The protective recess 112 is also shown as a dark outline in the embodiment shown in FIG. 5. The protective recess 112 has edge protector pockets 502 located in the four corners of the protective recess 112. The edge protector pockets 502 are adapted to protect the corners of the flat item 500 such that when the flat item 500 rotates, as shown in FIG. 5, the corners of the flat item 500 do not contact the edges of the protective recess 112. Preferably, the internal dimensions of the protective recess 112 and the edge protector pockets 502 are adapted such that when the flat item 500 moves or shifts within the protective recess 112, the flat item 500 contacts on the length of the flat item 500, at point 600 in FIG. 6 and at point 700 in FIG. 7, rather than at the flat item's 500 corners. The edge protector pockets 502 corners 702 are shown in this embodiment as substantially square. In alternative embodiments, these corners 702 are chamfered, filleted, curved, or otherwise broken to further increase the contact area between the flat item 500 and the recess walls 310 of the protective recess 112.

In one embodiment, the protective recess 112 is sized according to the following formula that predicts the exact size and shape of the recess necessary to protect the corners of a flat item 500 stored within the protective enclosure 100. In FIG. 5, there are dimensions x and y defining the width and height respectively of the flat item 500 and dimensions x' and y' defining the width and height respectively of the protective recess 112. Note that the protective recess 112 in this embodiment is not circular in shape but is designed according to the desired overall size and shape of the protective enclosure 100 and the contents to be contained within. The following formulations provide the length p, and the width w of the edge protector pockets 502 in a given protective enclosure 100 necessary to prevent the corners of the flat item 500 contained within from impacting the recess walls 310 of the protective recess 112.

$$l_x=0.95(x'-x) \quad 4\text{-}1$$

$$l_y=0.78(y'-y) \quad 4\text{-}2$$

$$l'_y=l_y+\text{desired distance from comic case} \quad 4\text{-}3$$

$$l'_x=l_x+\text{desired distance from comic case} \quad 4\text{-}4$$

$$p=(l'_x-l_x)\tan\left[\cos^{-1}\left(\frac{x}{x'-l_x}\right)\right] \quad 4\text{-}5$$

$$w=(l'_y-l_y)\tan\left[\cos^{-1}\left(\frac{y}{y'-l_y}\right)\right] \quad 4\text{-}6$$

1.f. Protective Enclosure 100 for a Collectible Comic Book

Figure 8:
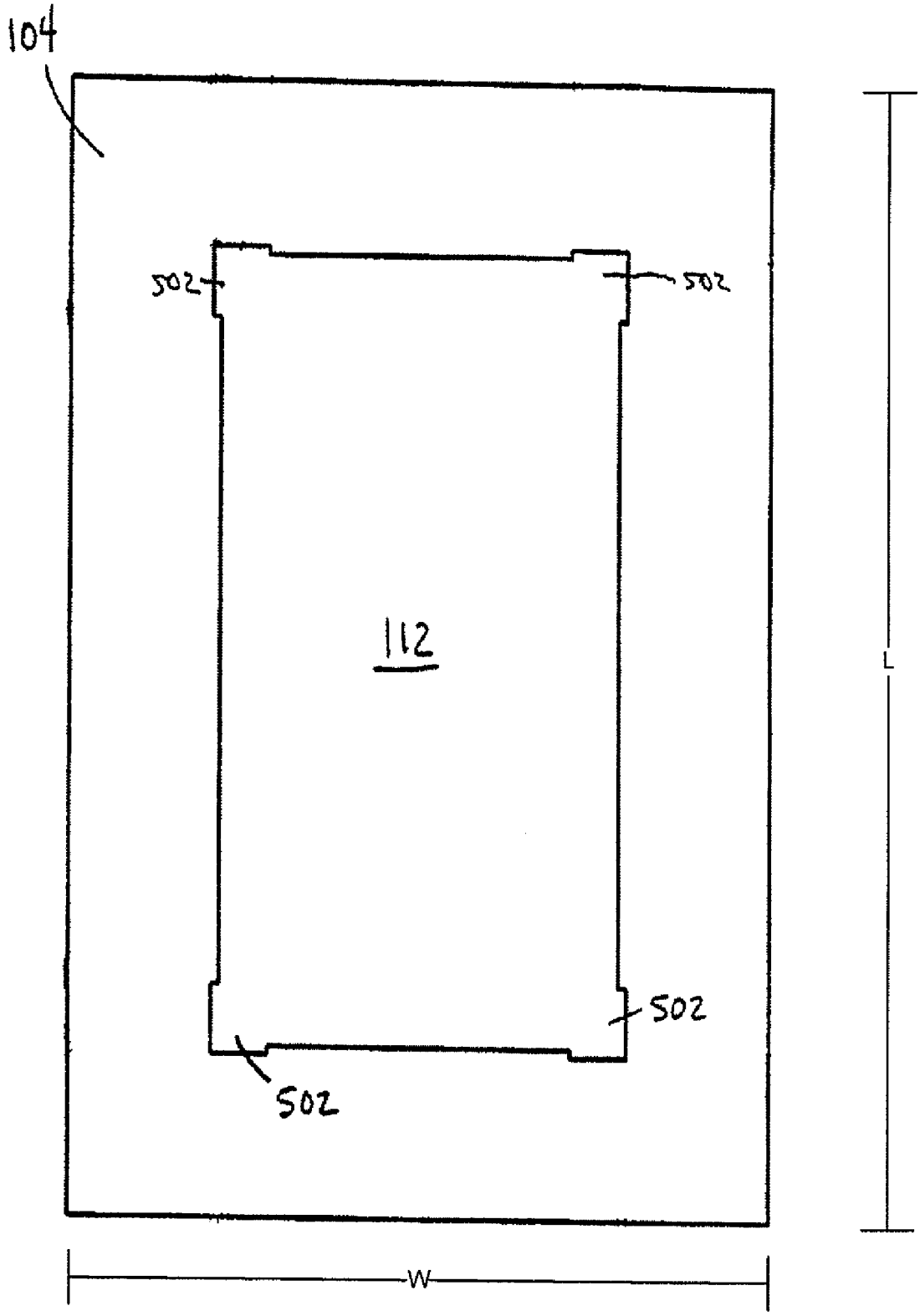
FIG. 8 is a detail view of the preferred internal shape of a protective enclosure for containing a comic book.
Figure 9:
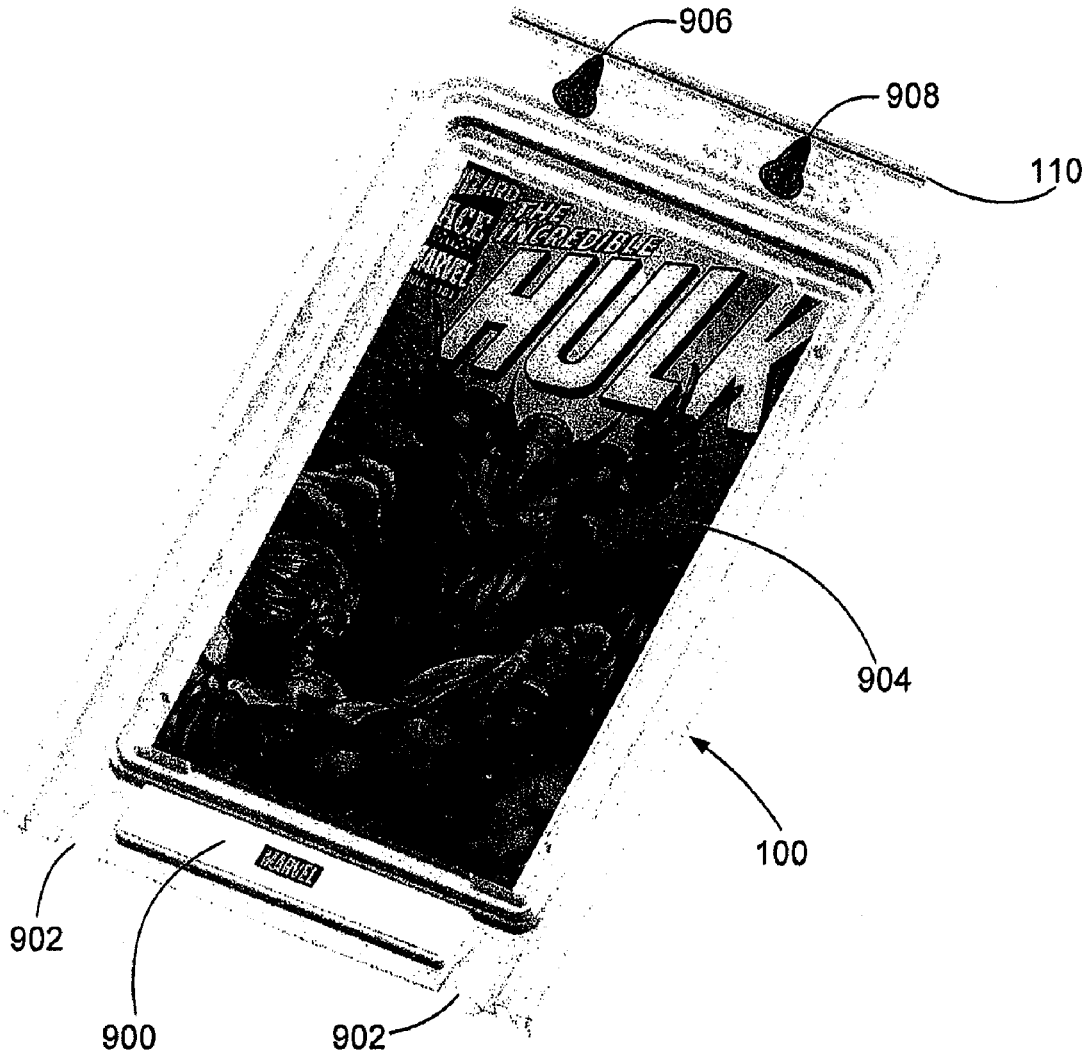
FIG. 9 shows a collectible item enclosed within the protective enclosure with a label.

FIGS. 8 and 9 depict an embodiment of the protective enclosure 100 adapted to protect and house a specific flat item 500, in this case a collectible comic book 804. FIG. 8 shows the preferred size of such a protective enclosure 100 whereas FIG. 9 shows such a protective enclosure 100 containing a comic book 904. In this embodiment, the protective enclosure 100 has the following overall dimensions:

Overall closed length (L)=15"
Overall Open Length=29⅝"
Width from edge to edge (W)=9⅞"
Height (Closed)=½"
Material thickness=0.025"

The protective enclosure 100 in the embodiment depicted in FIGS. 8 and 9 also includes a pair of finger holes 902 in a front edge of the protective enclosure that enable the upper face 102 and the lower face 104 of the protective enclosure 100 to be separated easily to reach the comic book 904 located within.

1.g. Additional Elements

The protective enclosure 100 in other embodiments also includes a number of additional elements that are incorporated into the device. In one embodiment, these additional elements include an Acid Inhibitor—an insert that goes between the front cover and first page of the comic book 904, and the back cover and last page. This insert would consist of a porous paper that helps to prevent acid from the inside pages damaging the cover. In yet another embodiment, these additional elements include stuffers for placement of a comic book 904 that is thinner than the ⅛$^{th}$ inch thick. A stuffer consists of a thin piece of plastic, being about 1/16$^{th}$ in thickness and substantially the same length and width of a comic book, that helps keep the comic book 904 tightly in place while in the protective enclosure 100, thereby preventing the comic book 804 from slipping within the protective recess 112.

2. Free Standing Protective Enclosure Display System

Figure 10:
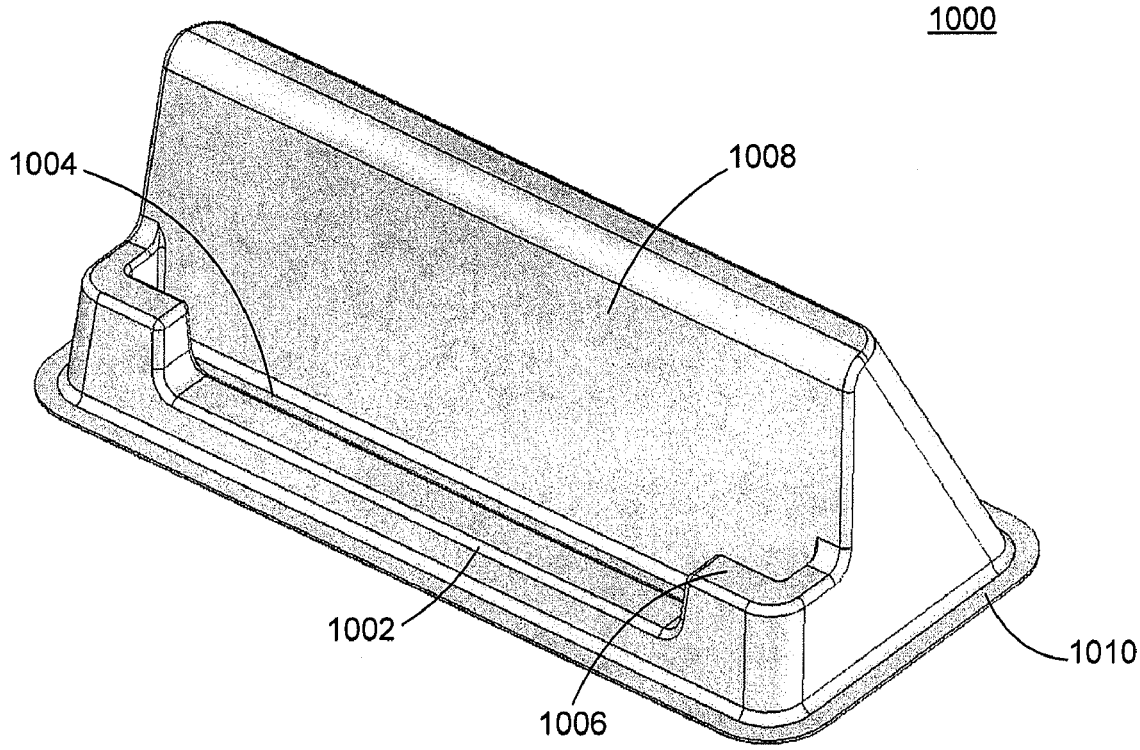
FIG. 10 is a perspective view of the display stand adapted to hold a protective enclosure upright for display of the item contained within.
Figure 11:
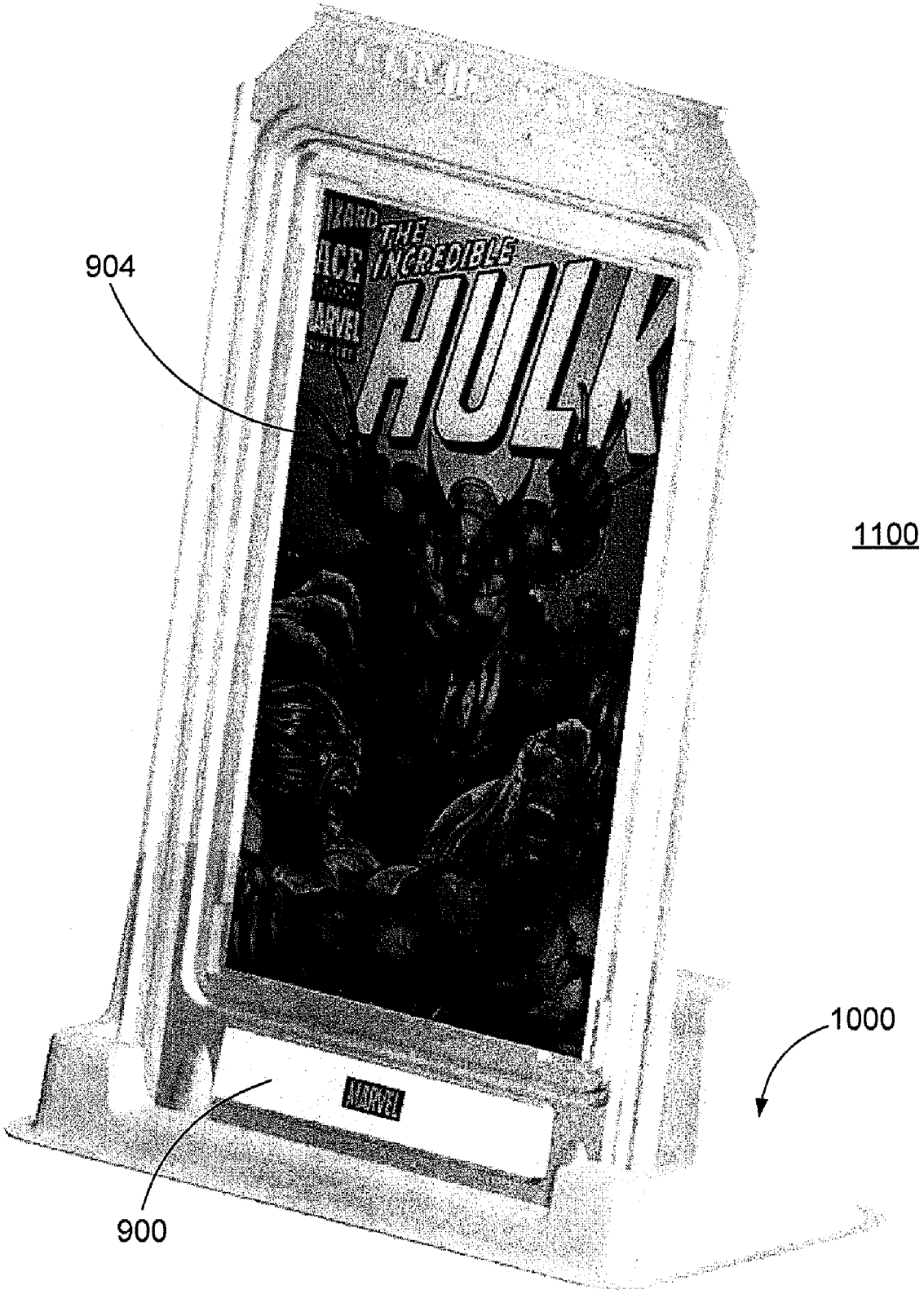
FIG. 11 is a perspective view of a display stand with a protective enclosure inserted for display of the collectible item enclosed within the protective enclosure.

FIGS. 10 and 11 depict an embodiment wherein there is a free standing holder 1000 that enables the protective enclosure 100 to be propped up 1100 in order to display the comic book 904 thereby creating a protective enclosure display 1000 as shown in FIG. 10. The free standing holder 1000 has a lower lip 1002, that in conjunction with the back 1008 and retaining tabs 1006, form a retaining well 1004. The retaining well 1004 is adapted to accept the lower edge of a protective enclosure 100 such that the protective enclosure 100 does not slip out of the retaining well 1004. The lower surface 1010 of the free standing holder 1000 in this embodiment may have friction enhancement materials, such as a pad, fabric, or a granular surface, applied to the lower surface 1010 to prevent the free standing holder 1000 from slipping on most surfaces. The free standing holder 1000 in the depicted embodiment is formed of an injection molded plastic, in this case polystyrene. Other materials and fabrication techniques maybe selected by one of ordinary skill in the art, including but not limited to vacuum molding, die casting, stamping, casting, and machining. In yet another embodiment, the free standing holder 1000 has an additional weight added to the lower surface 1010, or within the free standing holder 1000 itself, to provide additional stability.

3. Wall Display

The protective enclosure 100, and specifically the lower face 104 in yet another embodiment is fabricated with a hole 906, 908 and/or notch in the surface that enables the protective enclosure 100 to be hung on a wall using a hook, nail, or screw. In still another embodiment, the protective enclosures 100 are designed with an additional plastic element that enables a single protective enclosure 100 to be locked into an interlocked, stacked wall of protective enclosures 100, thereby creating a display that does not need nails or hooks. In still another embodiment, display tabs are fabricated that resemble elements of the interlocking stacking interface 400 formed by a second protective enclosure without the associated enclosure. The display tabs are thus mounted to a wall, and then protective enclosures 100 for display are mounted on the display tabs using the same interlocking stacking interface 400 formed when multiple the protective enclosures 100 are stacked in an interlocking manner.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined. Thus, the breadth and scope of the present invention should not be limited by any of the above-described exemplary embodiments.

What is claimed is:

1. A protective enclosure for storing an item, comprising:

an upper face and a lower face foldably connected by a living hinge enabling said upper face and said lower face to transition between an open position and a closed position, said lower face having a protective recess of a size and shape adapted to receive the item, wherein said upper face and said lower face form an interlocking interface around said protective recess when the protective enclosure is in a closed position, and wherein an upper locking interface of said upper face comprises a cavity having a first inner wall and a first outer wall, and wherein a lower locking interface of said lower face comprises a protrusion having a second inner wall and a second outer wall, said upper locking interface and said lower locking interface enclosing said protective recess when the protective enclosure is in the closed position, and wherein said first inner wall of said cavity forms a first interlocking surface of said interlocking interface with said second inner wall of said protrusion, and said first outer wall of said cavity forms a second interlocking surface of said interlocking interface with said second outer wall of said protrusion;

a label area formed from an upper label area of said upper face and a lower label area of said lower face, said label area adapted for receiving a label; and a first interlocking stacking interface separate from said interlocking interface and having a first upper stacking lip and a first lower stacking lip along a first long side of the protective enclosure and a second interlocking stacking interface separate from said interlocking interface and having a second upper stacking lip and a second lower stacking lip along a second long side of the protective enclosure, said first interlocking stacking interface receiving a third interlocking stacking interface separate from said interlocking interface and having a third upper stacking lip and a third lower stacking lip of a second protective enclosure when the protective enclosure is in said closed position and the protective enclosure is stacked with a second protective enclosure also in said closed position, and wherein a first depression in said first upper stacking lip is formed having an inner width between an inner vertical edge and an approximately vertical inner wall of a stacking protrusion in said first interlocking stacking interface, said first depression being approximately rectangular in cross section, and wherein a second depression in said first lower stacking lip is formed having an outer width between an outer vertical edge and an inner wall of said first lower stacking lip in said first interlocking stacking interface, said second depression being approximately rectangular in cross section and said outer width of said second depression being less than said inner width of said first depression, and wherein an outside surface of said inner vertical edge abuts an inside surface of said outer vertical edge to interlock said first interlocking stacking interface when the protective enclosure is in said closed position, and wherein when the protective enclosure is stacked with said second protective enclosure, said first depression receives a third depression of said third interlocking stacking interface, said third depression being approximately rectangular in cross section and having said outer width between an outer vertical edge and an inner wall of said third lower stacking lip.

2. The protective enclosure of claim 1, wherein the protective enclosure is a material selected from the group consisting of: polyvinylchloride (PVC), Amorphous Polyethylene Terephthalate (APET), polycarbonate, polystyrene, and polyethylene.

3. The protective enclosure of claim 1, wherein said upper face is substantially transparent and said lower face is substantially opaque.

4. The protective enclosure of claim 1, wherein the protective enclosure is a material having ultraviolet light spectrum protection.

5. The protective enclosure of claim 1, wherein said label area is angled about 5 degrees to about 30 degrees from a longitudinal axis of said protective recess.

6. The protective enclosure of claim 1, further comprising a gasket between said upper locking interface and said lower locking interface.

7. The protective enclosure of claim 1, further comprising a permanent seal between said upper locking interface and said lower locking interface.

8. The protective enclosure of claim 1, wherein said protective recess has a plurality of edge protector pockets, each said edge protector pocket receiving a corner of the item and preventing lateral contact between said corner of the item and the protective enclosure when the item is placed within said protective recess.

9. The protective enclosure of claim 8, wherein said edge protector pockets have a shape selected from the group consisting of: square, chamfered, filleted, curved, and broken contour.

10. The protective enclosure of claim 8, wherein each said edge protector pocket has a length p and a width w as set forth in the formulas:

$$l_x=0.95(x'-x)$$

$$l_y=0.78(y'-y)$$

$$l'_y=l_y+\text{distance between said protective closure and said item}$$

$$l'_x=l_x+\text{distance between said protective closure and said item}$$

$$p=(l'_x-l_x)\tan\left[\cos^{-1}\left(\frac{x}{x'-l_x}\right)\right]$$

$$w=(l'_y-l_y)\tan\left[\cos^{-1}\left(\frac{y}{y'-l_y}\right)\right]$$

wherein x and y=width and height, respectively, of said item and x' and y'=width and height, respectively, of said protective recess.

11. The protective enclosure of claim 1, wherein the protective enclosure has: a length of about 29-30 inches in the open position, a length of about 15 inches in the closed position, a width of about 9-10 inches, a height of about ½ an inch in the closed position, and a material thickness of about 0.025 inches.

12. The protective enclosure of claim 1, further comprising a finger hole in a front edge of the protective enclosure.

13. The protective enclosure of claim 1, further comprising a means for hanging the protective enclosure on a vertical surface.

14. A method for storing an item, comprising the steps of:

(a) opening a protective enclosure, said protective enclosure having:

an upper face and a lower face foldably connected by a living hinge enabling said upper face and said lower face to transition between an open position and a closed position, said lower face having a protective recess of a size and shape adapted to receive the item, wherein said upper face and said lower face form an interlocking interface around said protective recess when the protective enclosure is in a closed position, and wherein an upper locking interface of said upper face comprises a cavity having a first inner wall and a first outer wall, and wherein a lower locking interface of said lower face comprises a protrusion having a second inner wall and a second outer wall, said upper locking interface and said lower locking interface enclosing said protective recess when said protective enclosure is in the closed position, and wherein said first inner wall of said cavity forms a first interlocking surface of said interlocking interface with said second inner wall of said protrusion, and said first outer wall of said cavity forms a second interlocking surface of said interlocking interface with said second outer wall of said protrusion;

a label area formed from an upper label area of said upper face and a lower label area of said lower face, said label area adapted for receiving a label; and a first interlocking stacking interface separate from said interlocking interface and having a first upper stacking lip and a first lower stacking lip along a first long side of the protective enclosure and a second interlocking stacking interface separate from said interlocking interface and having a second upper stacking lip and a second lower stacking lip along a second long side of the protective enclosure, said first interlocking stacking interface and said second interlocking stacking interface adapted for receiving a third interlocking stacking interface separate from said interlocking interface and having a third upper stacking lip and a third lower stacking lip of a second protective enclosure when said protective enclosure is in said closed position and said protective enclosure is stacked with a second protective enclosure also in said closed position, and wherein a first depression in said first upper stacking lip is formed having an inner width between an inner vertical edge and an approximately vertical inner wall of a stacking protrusion in said first interlocking stacking interface, said first depression being approximately rectangular in cross section, and wherein a second depression in said first lower stacking lip is formed having an outer width between an outer vertical edge and an inner wall of said first lower stacking lip in said first interlocking stacking interface, said second depression being approximately rectangular in cross section and said outer width of said second depression being less than said inner width of said first depression, and wherein an outside surface of said inner vertical edge abuts an inside surface of said outer vertical edge to interlock said interlocking stacking interface when the protective enclosure is in said closed position, and wherein when the protective enclosure is stacked with said second protective enclosure, said first depression receives a third depression of said third interlocking stacking interface, said third depression being approximately rectangular in cross section and having said outer width between an outer vertical edge and an inner wall of said third lower stacking lip;

(b) inserting the item into said protective recess of said protective enclosure; and (c) closing said protective enclosure.

15. The method of claim 14, further comprising the step of:

(d) interlocking said protective enclosure with a second protective enclosure wherein said first interlocking stacking interface removably connects to a third interlocking stacking interface of said second protective enclosure.

16. The method of claim 14, further comprising the step of:

(d) attaching a label to said label area, wherein said label identifies the item.

17. The method of claim 14, further comprising the step of:

(d) permanently sealing said protective enclosure in the closed position.

18. The method of claim 14, wherein said protective recess has a plurality of edge protector pockets, each said edge protector pocket adapted to receive a corner of the item and prevent lateral contact between the corner of the item and said protective enclosure.

19. The method of claim 18, wherein said edge protector pockets have a shape selected from the group consisting of: square, chamfered, filleted, curved, and broken contour.

20. The method of claim 18, wherein each said edge protector pocket has a length p and a width w as set forth in the formulas:

$$l_x=0.95(x'-x)$$

$$l_y=0.78(y'-y)$$

$$l'_y=l_y+\text{distance between said protective closure and said item}$$

$$l'_x=l_x+\text{distance between said protective closure and said item}$$

$$p=(l'_x-l_x)\tan\left[\cos^{-1}\left(\frac{x}{x'-l_x}\right)\right]$$

$$w=(l'_y-l_y)\tan\left[\cos^{-1}\left(\frac{y}{y'-l_y}\right)\right]$$

wherein x and y=width and height, respectively, of said item and x' and y'=width and height, respectively, of said protective recess.

* * * * *